United States Patent [19]

Tanabe

[11] Patent Number: 4,868,348

[45] Date of Patent: Sep. 19, 1989

[54] WELDING CABLE

[75] Inventor: Katuji Tanabe, Tokyo, Japan

[73] Assignee: Obara Corporation, Tokyo, Japan

[21] Appl. No.: 255,620

[22] Filed: Oct. 7, 1988

Related U.S. Application Data

[63] Continuation-in-part of Ser. No. 164,571, Mar. 7, 1988, abandoned.

[30] Foreign Application Priority Data

Oct. 16, 1987 [JP] Japan ..... 62-157530

[51] Int. Cl.[4] ..... H01B 7/34; H01R 11/16

[52] U.S. Cl. ..... 174/15.7; 174/19; 174/74 R; 219/137.9

[58] Field of Search ..... 174/15.7, 19, 74 R, 174/75 R; 219/137.9

[56] References Cited

U.S. PATENT DOCUMENTS

| | | | |
|---|---|---|---|
| 2,879,317 | 3/1959 | Wreford | 174/15.7 |
| 3,127,467 | 3/1964 | Toto | 174/19 |
| 3,333,044 | 7/1967 | Toto | 174/15.7 |
| 3,456,064 | 7/1969 | Toto | 174/19 |
| 4,018,976 | 4/1977 | Grove | 174/15.7 X |
| 4,199,653 | 4/1980 | Talley | 174/15.7 |
| 4,487,990 | 12/1984 | Lane et al. | 174/15.7 |

FOREIGN PATENT DOCUMENTS 61-16811 1/1986 Japan .

*Primary Examiner*—Morris H. Nimmo

*Attorney, Agent, or Firm*—Flynn, Thiel, Boutell & Tanis

[57] ABSTRACT

A welding cable having an elongate insulating separator formed by six walls which project radially outwardly in circumferentially spaced relation to define six spaces which extend around the separator and open radially outwardly. A plurality of positive and negative conductors are alternately arranged within the circumferentially adjacent spaces. The separator, at least in the vicinity of an end thereof, is axially diametrically split into two axially extending separator parts, each including a pair of outer spaces disposed on opposite sides of an intermediate space. A positive and a negative conductor respectively extend along the intermediate space of the first and second separator parts. A pair of negative conductors, which normally extend along the outer spaces of the first separator part, are extracted radially outwardly and are inserted into the outer spaces of the second separator part. The positive conductors which normally extend along the outer spaces of the second separator part are extracted radially outwardly and inserted into the outer spaces of the first separator part. The extracted positive conductors are provided with insulating covers. The first separator part and the three positive conductors grouped therein are fixed to one terminal contact end, and the second separator part and the three negative conductors therein are fixedly secured to another terminal contact end.

2 Claims, 3 Drawing Sheets

WELDING CABLE

This application is a continuation-in-part of U.S. Ser. No. 164,571, filed Mar. 7, 1988, now abandoned.

BACKGROUND OF THE INVENTION

1. Field of the Invention

The present invention relates to a welding cable comprising twisted positive and negative conductors alternately arranged one after another within spaces defined by division pieces formed by separating radially equally an insulating separator into six circumferentially adjacent spaces.

2. Prior Art

The inventor of the present invention has proposed the invention as disclosed in Japanese Utility Model Laid-Open Publication No. 61-16811, which is illustrated in FIGS. 6 and 7.

As illustrated in FIG. 6, positive twisted conductors a' and negative twisted conductors b' are alternately arranged one after another. A separator 11 is axially diametrically divided into two parts at an end thereof, namely, a separator part 11*a* and a separator part 11*b*. The twisted conductor a' or b' housed in one separator parts 11*b* or 11*a* as a small number of positive or negative conductors, for instance the number of conductors a' is less than the number of conductors b' in the separator part 11*b* and the number of conductors b' is less than the number of conductors a' in the separator part 11*a*, is covered with an insulating cover 13 and extracted from the separator parts 11*b* or 11*a* (FIG. 7). The extracted insulated conductors a' or b' are collected or put into a group of a large number of positive or negative conductors a' or b'. Each group of the same positive or negative conductors thus collected is pressedly fixed to terminal contact ends 14*a*, 14*b*, (FIG. 7).

In the conventional welding cable, there remains respectively one conductor in each of the separator parts which is not fully protected after the small number of twisted conductors is extracted from one separator part and put into the other separator part and vice versa. Therefore, the conductor which remains in the separator parts 11*b* or 11*a* is not satisfactorily protected by the separator part.

Accordingly, when the same group of positive or negative conductors are collected together in each of the separator parts and are pressedly fixed to the terminal contact ends, the remaining conductor which is unsatisfactorily protected by the separator part is liable to contact another unsatisfactorily protected conductor and/or other twisted conductors to thereby cause leakage of the current.

SUMMARY OF THE INVENTION

It is therefore an object of the present invention to protect the twisted conductors extracted from a first separator part and put into a second separator part and vice versa, namely, the twisted extracted positive and negative conductors are replaced with each other for collecting the same group of positive and negative conductors in the first and second separator parts, and at least one group of the positive or negative conductors is covered by an insulated cover, whereby leakage of the current is prevented.

To achieve the above object, a welding cable 5 according to the present invention comprises positive (a1, a2, a3) and negataive (b1, b2, b3) conductors alternately arranged between six division pieces or walls formed by separating radially equally a separator into six parts. The separator is divided, at an end thereof, into at least first and second separator parts (1*a*, 1*b*).

The twisted conductors a1, a2 or b2, b3 respectively located at both ends in said first or second separator part 1*a* or 1*b* are covered by insulating covers 3. The twisted conductors a1, a2 in said second separator 1*b* are replaced with those b2, b3 in said first separator part 1*a* so that the same positive or negative conductors are collected together and pressedly fixed to terminal contact ends 4*a*, 4*b* provided at both ends of the first and second separator parts 1*a*, 1*b* for connecting the first and second separator parts to terminals of a transformer and a welder gun (not shown).

The outer circumference of the twisted conductors a3 and b1 housed in the separator parts 1*a* and 1*b* are satisfactorily protected by the separator.

The twisted conductors a1 and a2 are covered by the insulating cover 3 and extracted from the separator part 1*b* and transferred to or put into the first separator part 1*a* and the twisted conductors b2 and b3 are extracted from the first separator part 1*a* and transferred to or put into the second separator part 1*b* so that the positive twisted conductors are collected together in the first separator part 1*a* and the negative twisted conductors are collected together in the second separator part 1*b*.

When the twisted conductors are transferred to the other separator part, the conductors are crossed with each other. However, no leakage of the current at the point of crossing of the conductors is generated since at least one set of the twisted conductors to be transferred are covered by the insulating covers 3.

The first separator part 1*a* thus collecting the same positive conductors is pressedly fixed to the terminal contact end 4*a* while the second separator part 1*b* is pressedly fixed to the terminal contact end 4*b*. The welding cable arranged in such a manner is served as a power supply for the welder.

The above and other objects, features and advantages of the present invention will become more apparent from the following description when taken in conjunction with the accompanying drawings.

PREFERRED EMBODIMENT OF THE INVENTION

Figure 1:
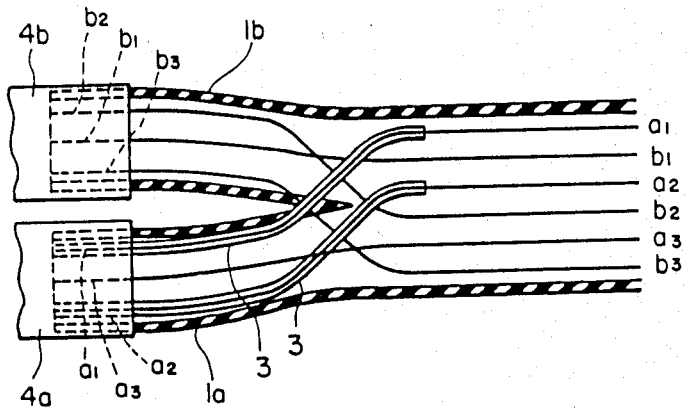
FIG. 1 is a view explaining a principle of connection of a welding cable with terminal contact ends.
Figure 2:
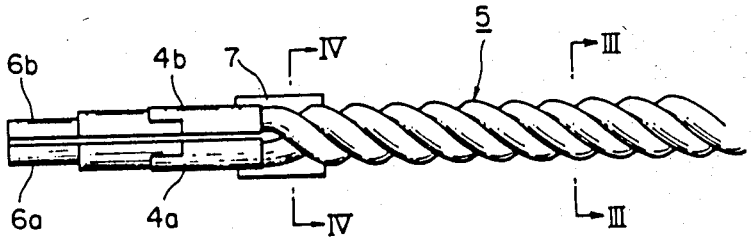
FIG. 2 is a schematic side view embodying the welding cable in FIG. 1.
Figure 3:
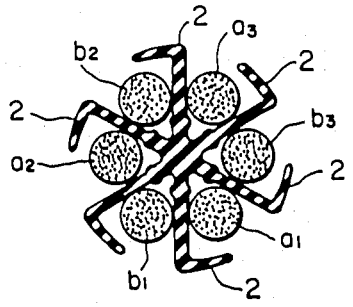
FIG. 3 is a cross-sectional view taken along the line III—III in FIG. 2.
Figure 4:
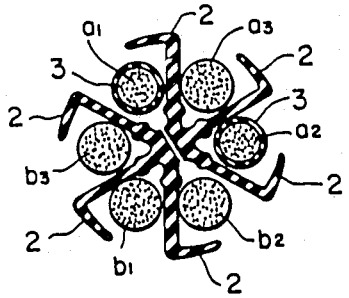
FIG. 4 is a cross-sectional view taken along the line IV—IV in FIG. 2.
Figure 5:
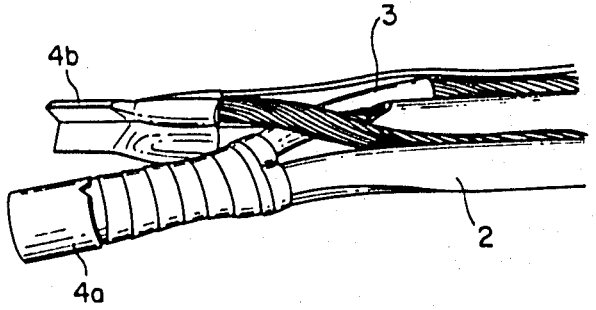
FIG. 5 is a perspective view showing separator parts and conductors.
Figure 6:
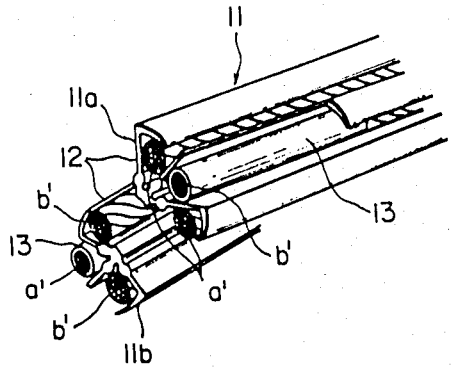
FIG. 6 (PRIOR ART)
FIG. 6 is a perspective view of a conventional welding cable.
Figure 7:
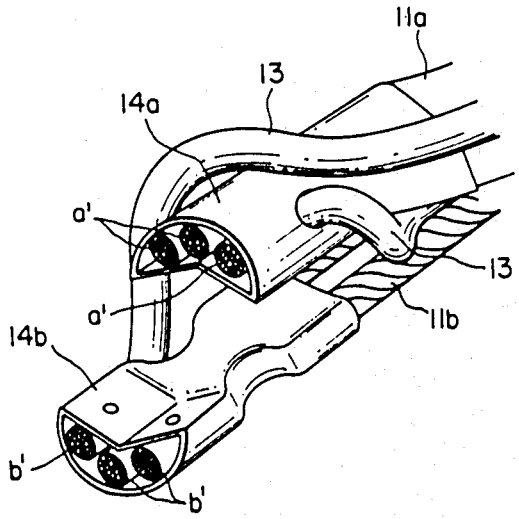
FIG. 7 (PRIOR ART)
FIG. 7 is an exploded perspective view showing the state of connection of the conventional welding cable of FIG. 6.

The welding cable according to the present invention will be described with reference to FIGS. 1 to 5.

A welding cable 5 has an insulating separator 1 composed of dividing walls or pieces 2 of L-shape cross section which divide the separator 1 radially equally in six parts. Positive twisted conductors a1, a2, a3 and negative twisted conductors b1, b2, b3 are alternately arranged in the spaces between the six radially-extending division pieces 2. The end of the separator 1 is equally (e.g. diametrically) divided along the line c—c in FIG. 3 into two axially-extending separator parts 1*a* and 1*b*.

The first separator part 1*a* has the twisted conductors b2, a3, b3 therein, and the second separator part 1*b* has the twisted conductors a1, b1, a2 therein. It is impossible to connect each of the first and second separators 1*a*, 1*b* directly to terminal contact ends since the conductor of the different electrode is repectively joined in the first and second separator parts 1*a* and 1*b*.

Accordingly, the twisted conductors b2, b3, a1, a2 respectively located at both sides within the first and second separator parts 1*a* and 1*b* are extracted from the first and second separator parts 1*a* and 1*b* and the positive conductors a1 and a2 are respectively covered by the insulating covers 3. Thenegative conductors b2, b3 may be covered by the insulating covers 3.

The twisted conductors a1, a2 are respectively inserted into portions of separator part 1*a* where the conductors b2, b3 where respectively located, and the conductors b2, b3 are respectively inserted into the portions of separator part 1*b* where the conductors a1, a2 were respectively located. That is, the twisted conductors other than the conductors a3 and b1 are respectively replaced with those in the other separator part so that the twisted conductors a1, a2, a3 are collected in the first separator part 1*a* while the twisted conductors b1, b2, b3 are collected in the second separator part 1*b*, and thereafter each of the separator parts 1*a* and 1*b* is respectively pressedly fitted to terminal contact ends 4*a*, 4*b*. The terminal contact ends 4*a*, 4*b* are respectively connected to terminals 6*a*, 6*b* of a transformer and a welder gun (not shown) are covered by a collar 7. The separator 1 may be divided its whole length thereof. Although the division pieces 2 are disclosed as of L-shape, it is not limited to such shape and may be T-shaped. Furthermore, all the conductors to be replaced with those in the other separator part may be covered with the insulating covers. Still furthermore, one of the terminal contact ends, for instance, 4*a* is protected by an insulating tape after the first separator part 1*a* is pressedly fixed to the terminal contact end 4*a*, so that the terminal contact end 4*a* may be electrically insulated with the other terminal contact end 4*b*.

With the arrangement of the present invention, the twisted conductors along with the respective separator part are pressedly fixed to the terminal contact end so that the intensity of insertion of the conductors and the separator parts are uniformly increased at the portion where the conductors are inserted into the terminal contact ends. As a result, it is possible to completely prevent breakage of the conductors caused by the bending of the welding cable so that the welding cable can be used for a long period of time. Also, it is possible to prevent unsatisfactory protection of the twisted conductors when the separator is divided to thereby prevent leakage of the current caused by direct contact of the twisted conductors. Furthermore, at least one group of the twisted positive or negative conductors are completely insulated at the time of the replacement of the twisted conductors so that there is no possibility of generating leakage of the current.

Although the invention has been described in its preferred form with a certain degree of particularity, it is to be understood that the present invention is not limited in practical application to the specific embodiment described herein and many changes and variations are possible in the invention without departing from the scope and spirit thereof.

What is claimed is:

1. A welding cable comprising:

an elongate insulating separator having a plurality of circumferentially-spaced radially-extending walls which define six spaces disposed circumferentially around the separator;

a group of three positive conductors and a group of three negative conductors, said positive and negative conductors being circumferentially alternately arranged in said spaces;

said separator, at least in the vicinity of one end thereof, being axially diametrically split into first and second axially-extending separator parts each having two outer said spaces disposed on opposite sides of an intermediate said space;

one of said positive conductors being disposed within and extending along the intermediate space of said first separator part throughout the length thereof, and one of said negative conductors being disposed within and extending along the intermediate space of said second separator part throughout the length thereof;

the remaining two said negative conductors, adjacent the ends thereof, being extracted radially outwardly from the outer spaces of said first separator part and inserted into the outer spaces of said second separator part, whereby all three said negative conductors in the vicinity of the ends thereof are grouped together on said second separator part;

the remaining two said positive conductors, adjacent the ends thereof, being extracted radially outwardly from the outer spaces of said second separator part and inserted into the outer spaces of said first separator part so that all three said positive conductors in the vicinity of the ends thereof are grouped together on said first separator part;

insulating covers positioned over portions of said two remaining positive or negative conductors which extend between said first and second separator parts;

a first contact terminal fixedly secured to the group of three positive conductors and to said first separator part, and a second contact terminal fixedly secured to the group of three negative conductors and said second separator part, whereby said contact terminals are adapted for connection with a transformer and a welding gun.

2. A welding cable according to claim 1, wherein portions of both said two remaining negative conductors and said two remaining positive conductors which extend between said first and second separator parts are provided with insulating covers thereon.

* * * * *